United States Patent [19]

Kneezel

[11] Patent Number: 5,075,690

[45] Date of Patent: Dec. 24, 1991

[54] TEMPERATURE SENSOR FOR AN INK JET PRINTHEAD

[75] Inventor: Gary A. Kneezel, Webster, N.Y.

[73] Assignee: Xerox Corporation, Stamford, Conn.

[21] Appl. No.: 452,178

[22] Filed: Dec. 18, 1989

[51] Int. Cl.[5] ..... B41J 2/05

[52] U.S. Cl. ..... 346/1.1; 346/140 R

[58] Field of Search ..... 346/140 R, 76 ph, 1.1; 338/195

[56] References Cited

U.S. PATENT DOCUMENTS

| | | | |
|---|---|---|---|
| 4,125,845 | 11/1978 | Stevenson | 346/140 R |
| 4,250,512 | 2/1981 | Kattner et al. | 346/140 R |
| 4,359,372 | 11/1982 | Nagal et al. | 204/192 |
| 4,449,033 | 5/1984 | McClure et al. | 219/216 |
| 4,532,530 | 7/1985 | Hawkins | 346/140 R |
| 4,636,812 | 1/1987 | Bakewell | 346/76 ph |
| 4,686,544 | 8/1987 | Ikeda et al. | 346/140 R |
| 4,704,620 | 11/1987 | Ichihashi et al. | 346/140 R |
| 4,719,472 | 1/1988 | Arakawa | 346/140 R |
| 4,738,871 | 4/1988 | Watanabe et al. | 427/96 |
| 4,772,866 | 9/1988 | Willens | 338/225 |
| 4,791,435 | 12/1988 | Smith et al. | 346/140 R |
| 4,881,057 | 10/1989 | Garcia et al. | 338/28 |
| 4,899,180 | 2/1990 | Elhatem et al. | 346/140 R |
| 4,910,528 | 3/1990 | Firl et al. | 346/1.1 |

FOREIGN PATENT DOCUMENTS 0007361 1/1983 Japan .

*Primary Examiner*—Benjamin R. Fuller
*Assistant Examiner*—Victor Devito

[57] ABSTRACT

An ink jet printhead is fabricated with a resistive temperature sensor formed adjacent to the heater resistors and, in a preferred embodiment, of the same material. Temperature sensing variations between a plurality of printheads used in the same printer is achieved by trimming the termistors to the desired resistance value while holding the printhead at the nominal set temperature. In one embodiment, the heater resistor and thermistor are formed within the same polysilicon layer, and the resistor trimmed therein. In a second embodiment, a thick or thin film resistor is formed of bonded in series with the polysilicon thermistor with the trimming being accomplished at the thick, or thin film resistor.

4 Claims, 3 Drawing Sheets

TEMPERATURE SENSOR FOR AN INK JET PRINTHEAD

BACKGROUND AND INFORMATION DISCLOSURE STATEMENT

This invention relates to a bubble ink jet printing system and, more particularly to a printhead having a temperature sensitive material incorporated therein which serves as a temperature sensor to effectively control heat generated during the printing operation.

Bubble jet printing is a drop-on-demand type of ink jet printing which uses thermal energy to produce a vapor bubble in an ink-filled channel that expels a droplet. A thermal energy generator (printhead), is located in the channels near the nozzle a predetermined distance therefrom. A plurality of resistors are individually addressed with a current pulse to momentarily vaporize the ink and form a bubble which expels an ink droplet. As the bubble grows, the ink is ejected from a nozzle and is contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separating of the bulging ink as a droplet. The acceleration of the ink out of the nozzle in which the bubble is growing provides the momentum and velocity of the droplet in a substantially straight line direction towards a recording medium, such as paper.

A problem with prior art printhead operation is the increase in temperature experienced by a printhead during an operational mode. With continued operation, the printhead begins to heat up, and the diameter of the ink droplet begins to increase resulting in excessive drop overlap on the recording media thereby degrading image quality. As the printhead experiences a further heat buildup, the ink temperature may rise to a point where air ingestion at the nozzle halts drop formation completely. It has been found that, at about 65° for a typical ink, printhead operation becomes unreliable. There is also a lower temperature limit for reliable operation which varies for different inks and device geometries. This limit might, for example, be about 20° C. for an ink and device designed to function reliably up to, for example, 60° C. At the same time, it is desirable to offer an extended range of ambient operating temperature, such as 5° C. to 35° C., so that it will be necessary to provide for warming up the printhead. It is also desirable to minimize the time required to warm up the printhead, so that first copy (print) out time is acceptable. The printhead characteristics and machine environment requirements have the following impact on the thermal design of the system. The generation of heat during operation (which becomes a greater problem as print speed, duration, and density increase) makes it necessary that the printhead be connected to a heat sink, which is efficient in transferring heat away from the printhead. The efficiency of the heat transfer away from the printhead will be enhanced by the cooler the heat sink is relative to the printhead. Because of the range of ambient temperatures to be encountered (assumed to be 5° C. to 35° C., but not limited to that range), and because of the temperature uniformity requirement, and further because it is less complicated and less expensive to control temperature by heating than by cooling, it is advantageous to set the nominal printhead operating temperature at or near the maximum ambient temperature encountered. Because of the desired minimal first copy (print) out time, as well as the desired efficiency of the heat sink, it is also advantageous to situate a temperature sensor and heater as close as possible (thermally) to the printhead, and as far as possible (thermally) from the heat sink.

Temperature regulation typically is achieved in the prior art by using a combination of a temperature sensor and a heater in a feedback loop tied into the printhead power source. For example, U.S. Pat. No. 4,250,512 to Kattner et al. discloses a heating device for a mosaic recorder comprised of both a heater and a temperature sensor disposed in the immediate vicinity of ink ducts in a recording head. The heater and sensor function to monitor and regulate the temperature of a recording head during operation. Column 3, lines 7-24 describes how a temperature sensor, a thermistor, a heating element, and a resistor operate in unison to maintain the recording head at an optimum operational temperature to maximize printing efficiency. U.S. Pat. No. 4,125,845 to Stevenson, Jr. discloses an ink jet printhead temperature control circuit which uses a heater and a temperature sensing device to maintain a recording head temperature above the preset temperature level. An output from the temperature sensing device drives an electrical heater which regulates the recording head temperature. The temperature sensing device is a resistive element attached to the bottom side of the printhead by thick film techniques. U.S. Pat. No. 4,704,620 to Ichihashi et al. discloses a temperature control system for an ink jet printer wherein the temperature of an ink jet printhead is controlled by a heater and a temperature sensor which collectively regulate heat transfer to maintain an ink jet printhead within an optimum stable discharge temperature range. The temperature control circuit, as shown in FIG. 7 of the patent, utilizes an output from a comparator circuit and control signals from a signal processing circuit to regulate printhead temperature based on the output from the temperature sensor. U.S. Pat. No. 4,791,435 to Smith et al. discloses a thermal ink jet printhead temperature control system which regulates the temperature of a printhead via a temperature sensing device and a heating component. The temperature sensing device, comprised of either a collection of transducers or a single thermistor closely estimates the temperature of the ink jet printhead and compensates for an unacceptable low printhead temperature by either cooling or heating the printhead as needed. U.S. Pat. No. 4,686,544 to Ikeda et al. discloses a temperature control system for "drop-on-demand" ink jet printers wherein a heat generating electrode, positioned between layers of insulating and resistive material of a printhead substrate, controls the temperature of the printhead during operation, Column 4, lines 7-25, describes how an electrothermal transducer delivers the heat required to maintain the ink jet printhead at an optimum temperature level to maximize efficiency printing efficiently. U.S. Pat. No. 4,636,812 to Bakewell, while disclosing a thermal printhead, also teaches using a heater and temperature sensor supported within a laminated layer near the marking resistors.

U.S. Pat. No. 4,738,871 to Watanabe et al. discloses a heat-sensitive recording head which makes use of laser-made holes to control the resistance of the heater resistors. These laser-made holes are also used to control the temperature which is directly related to the resistance. A method for making the laser holes is also provided.

U.S. Pat. No. 4,772,866 to Willens discloses a device including a temperature sensor. The temperature sensor uses the semiconductor material (polysilicon) which is already part of the device.

U.S. Pat. No. 4,449,033 to McClure et al. discloses a thermal printhead temperature sensing and control system. A sensor is made of a thermo-resistive material (Col. 4, lines 23-24) which runs parallel to the printhead leads. Means are provided for the temperature control circuitry for the printhead. The sensor can also sense a temperature change in a single printhead element (Col. 1, line 55). The sensor is situated above the printhead leads and separated from them by glass (FIG. 2, Numbers 10, 11).

The above references disclose various types of discrete temperature sensors which provide sensitivity for the particular system that they are used in. However, more precise temperature sensing and heater control may be required for certain print system depending upon printhead geometry, print speeds, and ambient operating temperature range. An optimum physical arrangement for a heater and sensor is to be in close proximity to the printhead. An optimum material from a manufacturing and economic standpoint is, for the temperature sensor to be formed from the same material as the resistor heating elements in the printhead. This goal, however, has not been achieved because the fabrication tolerances for the resistor are not sufficient for the purposes of forming sufficiently accurate thermometers on a plurality of printheads. In other words, it is heretofore not been possible to fabricate a plurality of printheads which may be required for a specific print system so that each temperature sensor for each printhead would be within a specific and consistent temperature tolerance range. A typical temperature coefficient of resistance of polysilicon is $1\times10^{-3}$/°C. and a typical resistance tolerance is ±5%. Thus, a thermistor formed near the resistor array would be inaccurate by as much as ±50° C. Depending on the temperature control and printhead performance, sensitivity to temperature for a specific system, a thermometer would have to obtain an accuracy of ±1°-5° C.

Thus, heretofore, it has not been possible to form a thermistor in close proximity to the printhead and of the same material as the heaters or the printhead. According to the present invention, however, it has been found that the accuracy of a thermistor of the same material as the printhead heater elements can be improved so that its accuracy is within the desired temperature range (of 1°-5° C.) by trimming the thermistor, or, by trimming an external resistor in series with the thermistor while holding the printhead at a desired temperature control set point. More particularly, the present invention is directed towards a thermal ink jet printhead including: a substrate support; an ink heating resistive layer disposed within said substrate comprising individual resistive elements in communication with an adjacent ink filled channel; and a second temperature sensitive resistive layer disposed within said substrate and proximate to said resistive layers, said temperature sensitive layer having an electrical connection to a temperature control circuit.

DESCRIPTION OF THE INVENTION

Figure 1:
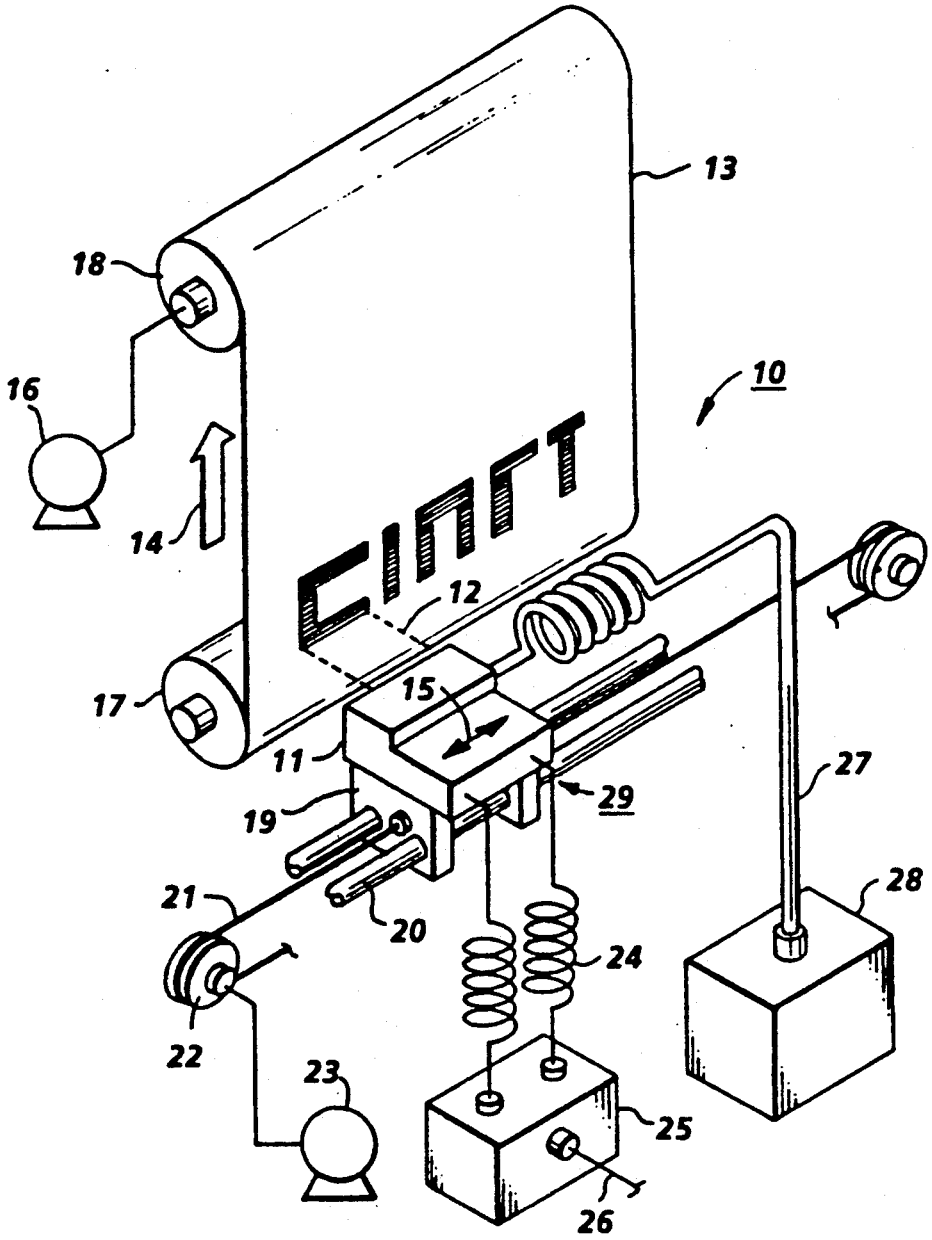
FIG. 1 is a schematic perspective view of a bubble jet ink printing system incorporating the present invention.

A typical carriage type bubble jet ink printing device 10 is shown in FIG. 1. A linear array of droplet producing bubble jet channels is housed in the printhead 11 of reciprocating carriage assembly 29. Droplets 12 are propelled to the recording medium 13 which is stepped by stepper motor 16 a preselected distance in the direction of arrow 14 each time the printing head traverses in one direction across the recording medium in the direction of arrow 15. The recording medium, such as paper, is stored on supply roll 17, and stepped onto roll 18 by stepper motor 16 by means well known in the art.

The printhead 11 is fixedly mounted on support base 19 which is adapted for reciprocal movement by any well known means such as by two parallel guide rails 20. The printhead and base comprise the reciprocating carriage assembly 29 which is moved back and forth across the recording medium in a direction parallel thereto and perpendicular to the direction in which the recording medium is stepped. The reciprocal movement of the printhead is achieved by a cable 21 and a pair of rotatable pulleys 22, one of which is powered by a reversible motor 23.

The current pulses are applied to the individual bubble generating resistors in each ink channel forming the array housed in the printing head 11. The pulses are applied along electrodes 24 carrying pulse signals from controller 25. The current pulses which produce the ink droplets are generated in response to digital data signals received by the controller 25 through electrode 26. The ink channels are maintained full during operation via hose 27 from ink supply 28.

Figure 2:
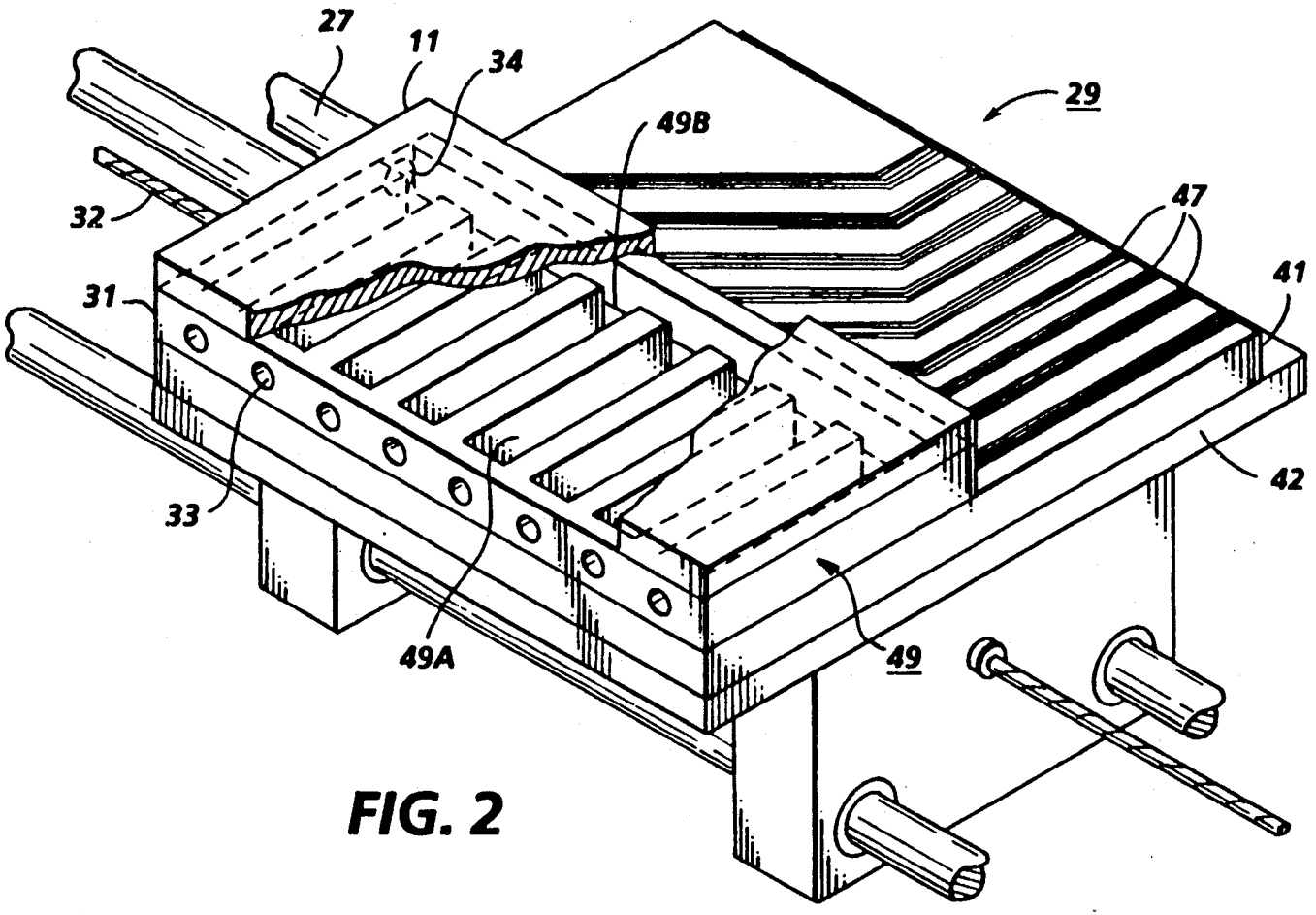
FIG. 2 is an enlarged schematic perspective view of the printhead of FIG. 1.

FIG. 2 is an enlarged partially sectioned, perspective schematic of the carriage assembly 29 shown in FIG. 1. The printhead 11 includes substrate 41 containing the electrical leads 47 and bubble generating resistors 44. Printhead 11 also includes channel plate 49 having ink channels 49*a* and manifold 49*b*. Although the channel plate 49 is shown in two separate pieces it could be an integral structure. The ink channels 49*a* and ink manifold 49*b* are formed in the channel plate piece 31 having the nozzles 33 at the end of each ink channel opposite the end connecting the manifold 49*b*. The ink supply hose 27 is connected to the manifold 49*b* via a passageway 34 in channel plate piece 31 shown in dashed line. Channel plate piece 32 is a flat member to cover channel plate piece 31 and together form the ink channel 49*a* and ink manifold 49*b* as they are appropriately aligned and fixedly mounted on substrate 41.

Figure 3:
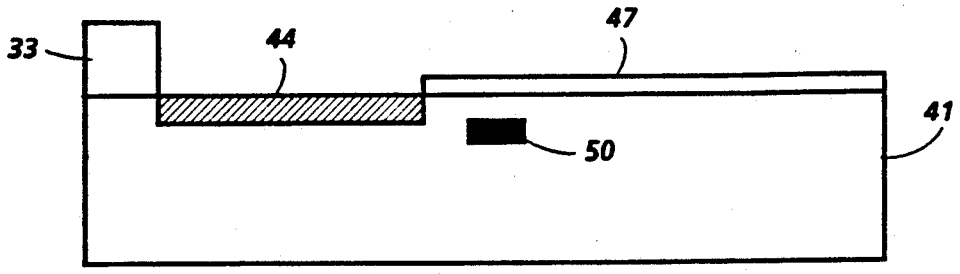
FIG. 3 is a cross-sectional side view of the printhead shown in FIG. 2.
Figure 4:
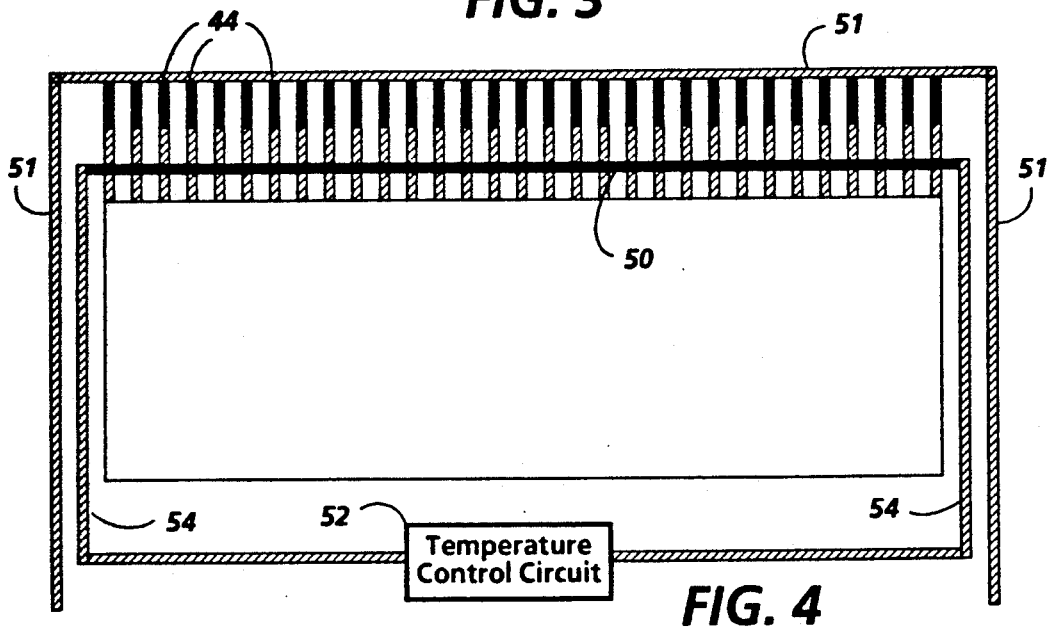
FIG. 4 is a top plan view of the printhead shown in FIG. 3.

Referring now to FIGS. 3 and 4, FIG. 3 shows (not to scale) a cross-sectional view of the substrate 41 of FIG. 2. Substrate 41 is comprised of a crystal material such as silicon. A resistive thermistor layer 50, formed by standard thin film or integrated circuit fabrication methods upon the silicon substrate, is connected to an outside temperature control circuit 52 by electrode leads 54. The resistive heating elements 44 are connected by common electrodes 51 which are pulsed by signals sent along electrodes 47 to expel ink from nozzle 33.

Figure 5:
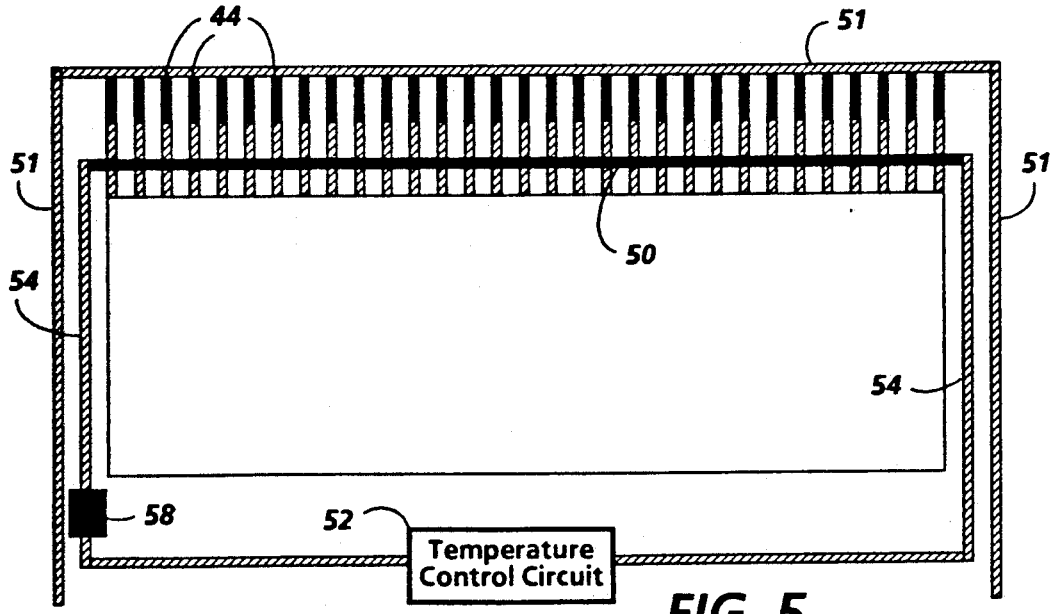
FIG. 5 is an alternate embodiment of the print head shown in FIG. 4.

According to a first aspect of the present invention, the resistive thermistor layer 50 is trimmed to a preselected resistance value by a laser trimming operation which is implemented at a time that the printhead is held at the set point temperature of interest. Since a laser trimming operation requires exacting tolerances, a simplified trimming operation can be performed by using the embodiment shown in FIG. 5. There, thick film, or, alternately, thin film resistor element 58 has been formed on the surface of substrate 41, or adjacent substrate (not shown) and connected in series with thermistor layer 50. The trimming operation is then performed on resistive element 58 until the desired resistance is achieved. For this embodiment, the total error in temperature reading from instability or temperature variation of the trimmed resistor will be in the order of 1° C. or less which is sufficiently accurate for a thermistor for thermal ink jet printing purposes. The external resistor to be trimmed may be formed as part of a hybrid circuit which also provides electrical interconnection to the printhead die. Alternatively, the resistor 58 to be trimmed may be added as a discrete chip resistor located on an adjacent substrate. For this example, the printhead may be packaged as a chip-on-board.

It will be appreciated that the above technique results in the elimination of resistance variability between a plurality of printheads being used in the same system, since all thermistors will operate in agreement with each other at the set temperature point of interest.

For the FIG. 4 embodiment the nominal resistance of the polysilicon thermistor 50 is about 20KΩ, and its temperature coefficient of resistance is about $1\times10^{-3}$/°C. (i.e., a change of 1° C. corresponds to a thermistor resistance change of 20Ω). Since the tolerance of the polysilicon resistor 44 will need to be kept within about ±5% from part to part and batch to batch, the thermistor will also be approximately this uniform (it may be slightly less uniform because of its high aspect ratio). In order to make the total resistance uniform at the set point, the trimmed resistance will need to vary over a range of about 2KΩ, for example, from 3KΩ (for devices in which the polysilicon is at its maximum resistance) to 5KΩ (for devices in which the polysilicon is at its minimum resistance). According to resistor paste specifications, the stability of a laser trimmed resistor during its lifetime (under load and under heat) is typically 0.2%. A 5KΩ trimmed resistor should be uniform to 10Ω during its lifetime, corresponding to an apparent temperature change of 0.5° C. The temperature coefficient of resistance of the thick film resistor is specified as $0\pm1\times10^{-4}$/°C. The temperature range of the substrate on which the external resistor 58 sits will almost certainly not exceed ±20° C. during operation of the printer. This would correspond to a resistance change that would not exceed ±10Ω, corresponding to an apparent temperature change of ±0.5° C. Thus, the total temperature error due to changes in the externally trimmed resistor will be on the order of 1° C. or less.

While the invention has been described with reference to the structure disclosed, it is not confined to the specific details set forth. For example, while a carriage was shown with a single printhead, the invention may be used in other configurations such as a page width printer.

I claim:

1. A thermal ink jet printhead including:

a silicon substrate, a polysilicon ink heating resistive layer disposed within said substrate comprising individual resistive elements in communication with adjacent ink filled channels, a temperature-sensitive polysilicon resistive layer disposed within said substrate and proximate to said polysilicon ink heating resistive layer, said temperature sensitive polysilicon resistive layer having a resistance value established by a trimming operation implemented while the printhead is at operating temperature and a temperature control circuit electrically connected to said temperature sensitive polysilicon resistive layer.

2. A thermal ink jet printhead including:

a silicon substrate, a polysilicon, ink heating resistive layer disposed within said substrate comprising individual resistive elements in communication with adjacent ink filled channels, a temperature-sensitive polysilicon resistive layer disposed within said substrate and proximate to said polysilicon ink heating resistive layer, a resistive element formed contiguous to said silicon substrate and connected in series with said temperature-sensitive polysilicon resistive layer, said resistive element having a resistance value established by a trimming operation implemented when the printhead is at operating temperature, and a temperature control circuit electrically connected to said resistive element.

3. A method for maintaining accurate temperature measurements of a thermal ink jet printhead comprising the steps of:

forming an ink-heating resistive layer with a silicon substrate, said ink-heating resistive layer comprising individual resistive elements in communication with adjacent ink-filled channels, forming a temperature-sensitive resistive thermistor layer within said silicon substrate and proximate to said ink-heating resistive layer, maintaining said printhead at a desired operating temperature while trimming said temperature-sensitive resistive layer to a desired resistance value and, providing an electrical connection between said temperature-sensitive resistive thermistor layer and a temperature control circuit.

4. A method for maintaining accurate temperature measurements of a thermal ink jet printhead comprising the steps of:

forming an ink-heating resistive layer within a silicon substrate, said ink-heating resistive layer comprising individual resistive elements in communication with adjacent ink-filled channels, forming a resistive thermistor layer within said silicon substrate and proximate to said ink-heating resistive layer, forming a thick film resistor in series with said resistive thermistor layer and trimming said thick film resitor to a desired resistance while maintaining said printhead at a desired operating temperature.

* * * * *